United States Patent [19]

Deffner

[11] 4,133,648

[45] Jan. 9, 1979

[54] ORGANIC SYNERGISTS FOR ORGANO-CERIUM (IV) ANTI-KNOCK ADDITIVES IN LEAD-FREE FUEL COMPOSITIONS

[75] Inventor: John F. Deffner, Glenshaw, Pa.

[73] Assignee: Gulf Research & Development Company, Pittsburgh, Pa.

[21] Appl. No.: 811,074

[22] Filed: Jun. 29, 1977

[51] Int. Cl.[2] ..... C10L 1/30

[52] U.S. Cl. ..... 44/68; 44/77; 252/386

[58] Field of Search ..... 44/77, 78, 68, 56; 252/386

[56] References Cited

U.S. PATENT DOCUMENTS

| | | | |
|---|---|---|---|
| 2,275,175 | 3/1942 | Cloud | 44/78 |
| 2,701,754 | 2/1955 | Haworth et al. | 44/77 |
| 3,976,437 | 8/1976 | Shang et al. | 44/56 |
| 4,036,605 | 7/1977 | Hartle | 44/68 |

*Primary Examiner*—Winston A Douglas
*Assistant Examiner*—Y. Smith-Harris

[57] ABSTRACT

This invention relates to lead-free fuel compositions having improved anti-knock and octane characteristics, which comprise a gasoline and, as a synergistic anti-knock and octane-improvement agent, a small amount of an organic compound selected from para-cresol or alkanediols such as 2,5-hexanediol in combination with an organo-cerium (IV) chelate.

14 Claims, No Drawings

ORGANIC SYNERGISTS FOR ORGANO-CERIUM (IV) ANTI-KNOCK ADDITIVES IN LEAD-FREE FUEL COMPOSITIONS

BACKGROUND OF THE INVENTION

1. Field of the Invention

This invention relates to improved lead-free fuel compositions which are suitable for use in spark ignition internal combustion engines. Recently the Federal Government has been concerned with the emission of pollutants into the atmosphere by automobiles, various industries, and the like. This concern, in many instances has taken the form of legislation which regulates or prohibits venting of various pollutants into the atmosphere. In particular, most automobiles produced after 1976 are required to use either unleaded gasoline or a similar substitute as a primary fuel. If anti-knock agents in the form of tetramethyl lead or tetraethyl lead are legislated from gasoline compositions, the alternate means of producing octane quality and anti-knock characteristics in these gasolines will be extremely important to refiners and ultimately to the consumer.

Since the discovery and commercialization of tetraethyl lead as an anti-knock and octane improvement agent, there has been an ongoing search for other materials and compounds that could be added to gasoline fuel compositions to suppress knock. Additionally, the automobile industry is currently investigating various devices for use in internal combustion engines to reduce the amount of hydrocarbons and carbon monoxide in the exhaust gasolines from such engines. One such device comprises a catalytic converter which is placed in the exhaust system of the engine. Unburned hydrocarbons and carbon monoxide contained in exhaust gases passing through the device are oxidized and converted to carbon dioxide. However, when gasoline compositions containing lead are burned in spark-ignition engines and the exhaust gases vented through these catalytic converters, the converters gradually become poisoned by lead compounds such as lead oxide, bromides, chlorides etc., and the converters are no longer effective for their intended purpose.

2. The Prior Art

The petroleum industry has long recognized the desirability of greater economy with respect to fuel requirement and greater efficiency in the operation of gasoline powered, spark-ignition engines. In many instances, high compression ratios are desired in order to provide for smooth engine performance under various driving conditions. Thus, it is necessary to employ fuels having high octane numbers and anti-knock characteristics to insure long engine life and to meet the requirements of smooth engine performance.

Numerous petroleum hydrocarbon conversion processes have been developed to meet the above-requirements, among which may be mentioned cracking, alkylation, aromatization, cyclization, isomerization, hydrogenation, dehydrogenation, hydroisomerization, polymerization, hydrodesulfurization, reforming, hydroforming, polyforming, "Platforming" and combinations of two or more of such processes. These processes produce hydrocarbons boiling in the gasoline boiling range which have engine performance characteristics markedly superior to the charge stock and to comparable boiling hydrocarbons found in straight-run gasolines. In general, straight-run gasolines are more paraffinic and less olefinic and aromatic than gasolines obtained, for example, by a cracking process. Straight-run gasolines generally do not give the high Motor and Research octane numbers required for smooth performance in present day engines. The base fuels used in the compositions of the present invention are, therefore, fuels or a blend of fuels obtained by one or more of the above-mentioned hydrocarbon conversion processes. However, a small amount of straight-run gasoline, in some instances, may be blended with the fuels obtained by a conversion process.

While octane ratings of fuels can be improved still further by additional refining and blending techniques, such additional processing is costly and heretofore has been considered economically unsound. Therefore, to improve the octane ratings of fuels obtained by one or more of the various conversion processes, the petroleum industry has resorted to the use of an anti-knock agent such as tetraethyl lead. However, the use of tetraethyl lead has been "legislated out" of gasoline compositions for most of the more recently manufactured automobiles, thus necessitating the need for new anti-knock agents suitable for use in gasoline compositions.

U.S. Pat. No. 3,794,473, entitled Rare Earth β-Ketoenolate Anti-Knock Additives In Gasolines, issued to Eseintrunt, on Feb. 26, 1974, teaches a motor fuel composition comprising as an anti-knock agent a rare earth β-ketoenolate wherein the rare earth element is selected from the group of lanthanun, cerium, etc. The rare earth β-ketoenolate is described as the sole anti-knock agent in the fuel composition. The reference does not, however, appreciate organic synergists for organo-cerium (IV) chelate anti-knock and octane-improvement agents.

Another gasoline anti-knock agent of interest is described in U.S. Pat. No. 3,770,397, issued to El-Ahmadi et al, on Nov. 6, 1973, entitled Liquid Hydrocarbon Fuels Containing Alkali Metal Salts of Alkyl and Dialkyl-Aminoalkyl Phenols, As Anti-Knock Agents. In particular, the lithium and sodium salts of organo-amino-cresols are described as suitable for use as anti-knock agents in gasoline compositions. In general, however, with the exception of tetramethyl lead and tetraethyl lead, none of these anti-knock agents described by the prior art have proved to be entirely satisfactory in effectively raising the octane number of the fuel without exhibiting other undesirable properties and characteristics.

SUMMARY OF THE INVENTION

The present invention resides in a lead-free fuel composition having improved anti-knock and octane characteristics which comprises a liquid hydrocarbon fuel containing an anti-knock and octane-improvement amount, especially from about 0.04 percent by weight to about 8.0 percent by weight of para-cresol or an alkanediol of the formula:

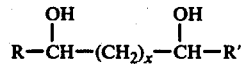

wherein R and R′ can be either alike or different, selected from hydrogen or a hydrocarbon radical having from about 1 to about 12 carbon atoms, preferably from about 1 to about 8 carbon atoms; and x is an integer of from about 1 to about 5, preferably from about 1 to about 3; in combination with an organo-cerium (IV) chelate of the formula:

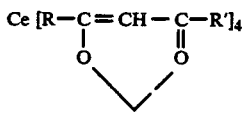

wherein R and R′ can be either alike or different members selected from the group consisting of hydrogen or hydrocarbon radicals including alkyl, aryl, aralkyl, alkaryl and cycloalkyl radicals containing from 1 to 12 carbon atoms with the sum of the carbon atoms in said radicals being from 3 to 24.

DETAILED DESCRIPTION OF INVENTION

In its broadest aspect, the present invention encompasses a lead-free fuel composition having improved octane and anti-knock characteristics which comprises a liquid hydrocarbon fuel containing an anti-knock and octane improvement agent selected from a synergistic combination of either para-cresol or an alkanediol and an organo-cerium (IV) chelate.

The above liquid hydrocarbon fuel can be derived from either natural or synthetic origin. For example, a suitable fuel derived from a natural origin is conventionally described as automotive or aviation fuels and usually comprise a petroleum fraction boiling in the gasoline hydrocarbon range of between about 70° F. (21.1° C.) and about 450° F. (232.2° C.); particularly having an initial boiling point in the range of about 80° F. (26.7° C.) to about 105° F. (40.6° C.), and a final boiling point in the range of about 360° F. (182.2° C.) to about 437° F. (225° C.). The fuel compositions of the present invention preferably are of the unleaded variety but can contain other additives associated with gasolines, such as corrosion inhibitors, deposit modifiers, oxidation inhibitors, metal deactivators, anti-static additives, anti-icing additives and the like.

Synthetic fuels suitable for use herein preferably are derived from solid carbonaceous materials, such as coal, which are conveniently prepared, for example, by blending finely ground carbonaceous material with a solvent to form a slurry. The slurry, together with hydrogen, is then introduced into a reaction vessel containing a conventional hydrogenation catalyst and is reacted under normal hydrogenating pressures and temperatures. After hydrogenation, solids that are present can conveniently be removed from the liquid product stream by any conventional separation procedure. The liquid product is next stripped of solvent and the balance of the product stream can be distilled to obtain products of various boiling ranges. Some of the products are useful as fuels. The remainder can be further treated by a conventional petroleum process including cracking, hydrocracking, and the like.

Synthetic liquid fuels produced from solid carbonaceous products such as coal are primarily aromatic and generally have a boiling range of about 70° F. (21.1° C.) to about 450° F. (232.2° C.) a density of about 0.9 to about 1.1 and a carbon to hydrogen molecular ratio in the range of about 1.3:1 to about 0.66:1. A typical example is a naphtha obtained from a subbituminous coal, such as Wyoming-Montana coal; having a boiling range of from about 357° F. (190.5° C.) to about 420° F. (215.6° C.).

The anti-knock and octane-improvement agents suitable for use herein comprises a synergistic combination of para-cresol or an alkanediol of the formula:

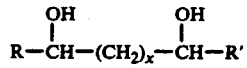

wherein R and R′ can be either alike or different, selected from hydrogen or a hydrocarbon radical having from about 1 to about 12 carbon atoms, preferably from about 1 to about 8 carbon atoms, most preferably from about 1 to about 5 carbon atoms; and x is an integer of from about 1 to about 5, preferably from about 1 to about 3. Examples of such compounds include:

1,4-pentanediol;
1,4-hexanediol;
1,5-hexanediol;
1,6-hexanediol;
2,5-hexanediol;
1,4-heptanediol;
2,5-heptanediol;
3,6-octanediol;
2-methyl-1,4-hexanediol;
6-methyl-1,4-heptanediol;
1,3-pentanediol;
2,4-pentanediol;
1,5-pentanediol;
3-methyl-2,4-pentanediol;
2,7-dimethyl-3,6-octanediol;
3,8-dimethyl-4,7-decanediol;
2,2,8,8-tetramethyl-4,7-decanediol;
7,10-hexadecanediol, and mixtures thereof.

The above agents are used in combination with an organo-cerium (IV) chelate of the formula:

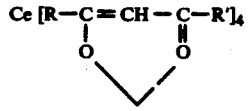

wherein R and R′ are either alike or different members selected from the group consisting of hydrogen and hydrocarbon radicals including alkyl, aryl, aralkyl, alkaryl and cycloalkyl radicals containing from 1 to 12 carbon atoms, preferably from about 1 to about 8 carbon atoms, most preferably from about 1 to about 5 carbon atoms, with the sum of the carbon atoms in said radicals being from 3 to 24, preferably from about 4 to about 10 carbon atoms. Examples of such radicals are methyl, ethyl, propyl, isopropyl, n-butyl, sec-butyl, tertiary butyl, n-amyl, tertiary amyl, n-hexyl, n-heptyl, triethylmethyl, n-octyl, isooctyl, nonyl, decyl, undecyl, dodecyl, phenyl, naphthyl, benzyl, phenethyl, tolyl, xylyl methylnaphthyl, ethylphenyl, propylphenyl, butylphenyl, amylphenyl, hexylphenyl, diethylphenyl, dipropylphenyl, trimethylphenyl, triethylphenyl, cyclopentyl, cyclohexyl, cyclooctyl, etc.

The organo-cerium (VI) chelates suitable for use herein can be prepared by any suitable or convenient manner. For example, one procedure can utilize an oxidative ligand exchange reaction wherein cerous acetylacetonate is reacted with a β-diketone substantially as illustrated by the following equation:

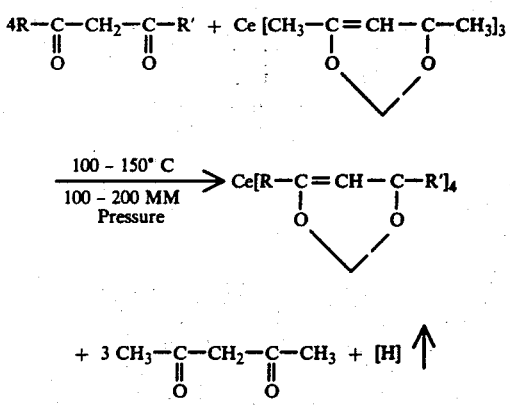

wherein R and R' are as defined above. A preferred method of preparing the organo-cerium (IV) chelates herein is set-forth in greater detail in currently pending U.S. application, Ser. No. 177,148 entitled Chelates of Cerium (IV), Their Preparation And Gasoline Containing Said Chelates, filed on Sept. 1, 1971 by Robert J. Hartle, the disclosure of which is incorporated herein by reference. Specific examples of preferred organo-cerium (IV) chelates include:

ceric 2,4-hexanedionate,
ceric 2,4-heptanedionate,
ceric 2,4-octanedionate,
ceric 3,5-heptanedionate,
ceric 3,5-octanedionate,
ceric 4,6-nonanedionate,
ceric 4,6-decanedionate,
ceric 5,7-undecanedionate,
ceric 6,8-tridecanedionate,
ceric 5,7-tetradecanedionate,
ceric 7,9-pentadecanedionate,
ceric 7,9-hexadecanedionate,
ceric 8,10-heptadecanedionate,
ceric 8,10-octadecanedionate,
ceric 9,11-nonadecanedionate,
ceric 9,11-eicosanedionate,
ceric 10,12-heneicosanedionate,
ceric 10,12-docosanedionate,
ceric 11,13-tricosanedionate,
ceric 11,13-tetracosanedionate,
ceric 12,14-pentacosanedionate,
ceric 12,14-hexacosanedionate,
ceric 13,15-heptacosanedionate,
ceric 2,2-dimethyl-3,5-hexanedionate,
ceric 2,2-dimethyl-3,5-heptanedionate,
ceric 2,2-dimethyl-3,5-octanedionate,
ceric 2,2-dimethyl-3,5-nonanedionate,
ceric 2,6-dimethyl-3,5-heptanedionate,
ceric 2,7-dimethyl-3,5-octanedionate,
ceric 2,2,6,6-tetramethyl-3,5-heptanedionate,
ceric 3,3,7,7-tetraethyl-4,6-nonanedionate,
ceric 1-phenyl-1,3-butanedionate,
ceric 1-phenyl-1,3-heptanedionate,
ceric 1-phenyl-1,3-undecanedionate,
ceric 1-phenyl-1,3-pentadecanedionate,
ceric 1-naphthyl-1,3-butanedionate,
ceric 1-benzyl-1,3-butanedionate,
ceric 1-tolyl-1,3-butanedionate,
ceric 1-cyclohexyl-1,3-butanedionate,
ceric 1,3-diphenyl-1,3-propanedionate,
ceric 1,3-dinaphthyl-1,3-propanedionate,
ceric 1,3-dibenzyl-1,3-propanedionate,
ceric 1,3-ditolyl-1,3-propanedionate,
ceric 1,3-dicyclohexyl-1,3-propanedionate, etc., and mixtures thereof.

DESCRIPTION OF PREFERRED EMBODIMENTS

In order to obtain the desired result herein it is critical that the liquid hydrocarbon fuel contain from about 0.04 to about 8.0 weight percent, preferably from about 0.1 to about 2.0 weight percent, based on the liquid hydrocarbon fuel, of the combined para-cresol or alkanediol and organo-cerium (IV) chelate. In addition, the weight ratios of said para-cresol or alkanediol to said organo-cerium (IV) chelate must be in the range of about 1:4 to about 7.5:1, preferably in the range of about 1.2:1 to about 5:1.

Specific examples of hydrocarbon distillate fuels that can be treated according to this invention include gasoline and synthetic liquid hydrocarbon fuels produced from solid carbonaceous compounds.

Gasoline, as defined herein, is a blend of petroleum hydrocarbons boiling within the range of from about 80° F. (27° C.) to about 437° F. (225° C.), which occur naturally in petroleum and natural gas or are produced in various refining processes such as alkylation, catalytic cracking, thermal cracking, and reforming. Gasoline has a hydrocarbon range of from about $C_4$ to about $C_{12}$ and is defined in ASTM Designation: D-439-75.

Synthetic fuels suitable for use in the present process are derived from solid carbonaceous products conveniently prepared by blending finely ground carbonaceous material with a solvent to form a slurry. The slurry is then introduced into a reaction vessel containing a conventional hydrogenation catalyst and is reacted under normal hydrogenating pressures and temperatures. After hydrogenation, solids that are present can conveniently be removed from the product stream, for example, by filtration. The product is next stripped of solvent. The balance of the product stream may be distilled to obtain products of various boiling ranges. Some of the products are useful as fuels, the remainder can be further treated by a conventional petroleum process including cracking, hydrocracking, and the like.

Synthetic liquid fuels produced from solid carbonaceous products such as coal are primarily aromatic and generally have a boiling range of about 70° F. (21.1° C.) to about 450° F. (232.2° C.), a density of about 0.9 to about 1.1 and a carbon to hydrogen molecular ratio in the range of about 1.3:1 to about 0.66:1. A typical example is a naphtha obtained from a subbituminous coal, such as Wyoming-Montana coal or a bituminous coal, such as Pittsburgh seam coal; comprising a middle oil having a boiling range of from about 100° F. (37.8° C.) to about 420° F. (215.6° C.). A description of how to prepare a synthetic fuel from carbonaceous material is set forth in greater detail in U.S. Pat. No. 3,957,619 issued to Chun et al on May 18, 1976, entitled "Process for the Conversion of Carbonaceous Materials", the disclosure of which is incorporated herein by reference.

In order to illustrate the beneficial synergistic effect of para-cresol or alkanediol and organo-cerium (IV) chelates on the anti-knock characteristics and octane number of hydrocarbon fuels, hydrocarbon fuel compositions were prepared using the agents disclosed herein. The test results are tabulated below.

Table I below demonstrates the anti-knock synergistic effect of 2,5-hexanediol on a typical organo-cerium (IV) chelate, for example, ceric 2,2,6,6-tetramethyl-3,5-heptanedionate (CTHD) and on the corresponding mixed rare earth additive (RETHD) in which 50 percent of the metal is cerium. Base gasoline A and B are typical lead free fuel compositions.

In Example I, the gasoline was formulated to contain 1.0 gram per gal. gasoline of cerium metal added as an organo-cerium (IV) chelate without an alkanediol. Analysis indicated the gasoline had a Motor Octane rating of 83.5 and a Research Octane rating of 92.1. When 8.4 grams per gal. gasoline of 2,5-hexanediol was added to gasoline composition, the Motor Octane rating increased to 84.0 and the Research Octane rating increased to 93.7 (see Example II). It is to be noted that the addition of 2,5-hexanediol to a lead free gasoline composition which does not contain an organo-cerium (IV) compound, has no effect on the octane rating of the composition.

In Example III below 33.7 grams per gal. of 2,5-hexanediol was added to a lead free gasoline composition containing 1.0 gram per gal. gasoline of cerium metal added as ceric 2,2,6,6-tetramethyl-3,5-heptanedionate. The octane rating did increase but not very much, indicating that there is an upper limit to the synergistic effect on a ratio basis of alkanediol to organic-cerium (IV) chelate.

Examples IV through VIII demonstrate similar synergistic effects of the mixed rare earth compound in which 50 percent of the metal is cerium in combination with an alkanediol when added to a lead free gasoline composition.

The data in Table I above clearly demonstrate a synergistic effect on octane rating and anti-knock characteristics when 2,5-hexanediol and ceric 2,2,6,6-tetramethyl-3,5-heptanedionate are added to gasolines. It is to be noted that other organo-cerium (IV) chelates as described herein can be substituted for the ceric 2,2,6,6-tetramethyl-3,5-heptanedionate above and other alkanediols as described herein can be substituted for the 2,5-hexanediol above with substantially the same results.

Table II below demonstrates the anti-knock synergistic effect between Para-cresol and a typical organo-cerium (IV) chelate, for example, ceric 2,2,6,6-tetramethyl-3,5-heptanedionate. In Example IX, the addition of 11.6 grams per gal. of Para-Cresol and 1.0 gram per gal. of cerium metal added as ceric 2,2,6,6-tetramethyl-3,5-heptanedionate increased the Motor Octane Number by 0.4 and the Research Octane Number by 0.9. Lead free gasolines which do not contain an organo-cerium (IV) chelate but do contain Para-Cresol increased in Motor Octane rating by 0.1 and in Research Octane rating by 0.3, thus, the difference between this increase in octane rating number and the increase in octane number when the two compounds are added to the gasoline in combination with each other is the synergistic effect on the anti-knock characteristics of the gasoline. In Examples X through XII, the ratio of Para-Cresol to the organo-cerium (IV) chelate is varied. The effect on octane rating is tabulated below.

Examples XIII through XV were conducted according to the procedure of Examples IX through XII with the following exception, the organo-cerium (IV) chelate contained a mixture of rare earth metals containing 50 percent cerium. The results are tabulated below.

TABLE I

| | SYNERGISTIC EFFECT OF 2,5-HEXANEDIOL AND ORGANO-CERIUM CHELATES | | | | | | | |
|---|---|---|---|---|---|---|---|---|
| Examples | I | II | III | IV | V | VI | VII | VIII |
| Make-Up: % by Vol. | | | | | | | | |
| Base Gasoline A (Lead Free) | 100 | 100 | 100 | — | — | — | — | — |
| Base Gasoline B (Lead Free) | — | — | — | 100 | 100 | 100 | 100 | 100 |
| Added: | | | | | | | | |
| Cerium, g . metal/gal.[1] | 1.0 | 1.0 | 1.0 | — | — | — | — | — |
| Rare Earth Metals, g. metal/gal.[2] | — | — | — | 1.5 | 1.5 | 1.5 | 1.5 | 1.5 |
| 2,5-Hexanediol, g./gal. | — | 8.4 | 33.7 | — | 6.3 | 12.7 | 25.4 | 50.7 |
| Mole Ratio, 2,5-hexanediol/metal | — | 10 | 40 | — | 5 | 10 | 20 | 40 |
| Octane Ratings | | | | | | | | |
| Motor Octane Number | 83.5 | 84.0 | 83.9 | 86.5 | 86.8 | 86.9 | 86.4 | 86.8 |
| ΔMotor Octane Number | — | 0.5 | 0.4 | — | 0.3 | 0.4 | −0.1 | 0.3 |
| Research Octane Number | 92.9 | 93.7 | 93.9 | 93.2 | 93.8 | 93.5 | 93.8 | 94.1 |
| ΔResearch Octane Number | — | 0.8 | 1.0 | — | 0.6 | 0.3 | 0.6 | 0. |

[1]Added as Ceric 2,2,6,6-tetramethyl-3,5-heptanedionate (CTHD)
[2]A mixture of rare earth metals containing about 50% cerium, added as the 2,2,6,6-tetramethyl-3,5-heptanedionate chelate (RETHD).

TABLE II

| | SYNERGISTIC EFFECT OF PARA-CRESOL AND ORGANO-CERIUM CHELATES | | | | | | |
|---|---|---|---|---|---|---|---|
| Examples | IX | X | XI | XII | XIII | XIV | XV |
| Make-Up: % by Vol. | | | | | | | |
| Base Gasoline A (Lead Free) | 100 | 100 | 100 | 100 | — | — | — |
| Base Gasoline B (Lead Free) | — | — | — | — | 100 | 100 | 100 |
| Added: | | | | | | | |
| Cerium, gm. metal/gal.[1] | 1.0 | 1.0 | 1.0 | 1.0 | — | — | — |
| Rare Earth Metals, g. metal/gal.[2] | — | — | — | — | 1.5 | 1.5 | 1.5 |
| p-Cresol, g./gal | 11.6 | 23.2 | 30.9 | 46.3 | 5.8 | 11.6 | 23.2 |
| Mole Ratio, p-Cresol/metal | 15 | 30 | 40 | 60 | 5 | 10 | 20 |
| Change in Octane Ratings | | | | | | | |
| ΔMotor Octane Number, Total | 0.4 | 0.7 | 0.7 | 0.4 | −0.1 | 0.0 | 0.0 |
| ΔMotor Octane number due to p-Cresol | 0.1 | 0.3 | 0.4 | 0.6 | 0.0 | 0.1 | 0.4 |
| ΔMotor octane number synergistic effect | 0.3 | 0.4 | 0.3 | −0.2 | −0.1 | −0.1 | −0.4 |
| ΔResearch Octane Number, Total | 0.9 | 0.9 | 1.1 | 0.7 | 0.5 | 0.2 | 0.3 |

TABLE II-continued

| Examples | SYNERGISTIC EFFECT OF PARA-CRESOL AND ORGANO-CERIUM CHELATES | | | | | | |
|---|---|---|---|---|---|---|---|
| | IX | X | XI | XII | XIII | XIV | XV |
| ΔResearch Octane number due to p-Cresol | 0.3 | 0.7 | 1.0 | 1.4 | 0.0 | 0.1 | 0.4 |
| ΔResearch octane number synergistic effect | 0.6 | 0.2 | 0.1 | −0.7 | 0.5 | 0.1 | −0.1 |

[1]Added as ceric 2,2,6,6-tetramethyl-3,5-heptanedionate (CTHD)
[2]A mixture of rare earth metals containing 50% cerium, added as the 2,2,6,6-tetramethyl-3,5-heptanedionate chelate (RETHD).

The data in Table II above clearly demonstrate a synergistic effect on octane rating and anti-knock characteristics when para-cresol and ceric 2,2,6,6-tetramethyl-3,5-heptanedionate are added to gasolines. Substantially the same results are obtained when other organo-cerium (IV) chelates disclosed herein are substituted for the ceric 2,2,6,6-tetramethyl-3,5-heptanedionate above.

EXAMPLE XVI 0.90 percent by weight of 2,5-heptanediol and 0.15 percent by weight ceric 2,2,6,6-tetramethyl-3,5-heptanedionate are added to a synthetic gasoline produced from solid carbonaceous materials, having a boiling range of from about 100° F. (37.8° C.) to about 420° F. (215.6° C.), a density of about 0.9 to about 1.1 and a carbon to hydrogen molecular ratio in the range of about 1.3:1 to about 0.66:1. The synthetic gasoline composition has enhanced octane rating and anti-knock characteristics. Substantially the same results are obtained when the organo-cerium (IV) chelates disclosed herein are substituted for the ceric 2,2,6,6-tetramethyl-3,5-heptanedionate above and the alkanediols disclosed herein are substituted for the 2,5,heptanediol above.

EXAMPLE XVII

A synthetic gasoline composition having enhanced octane rating and anti-knock characteristics is prepared by mixing 0.30 percent by weight of para-cresol and 0.15 percent by weight of ceric 2,2,6,6-tetramethyl-3,5-heptanedionate with a synthetic gasoline produced from solid carbonaceous materials, having a boiling range of from about 100° F. (37.8° C.) to about 420° F. (215.6° C.), a density of about 0.9 to about 1.1 and a carbon to hydrogen molecular ratio in the range of about 1.3:1 to about 0.66:1. The synthetic gasoline composition has enhanced octane rating and anti-knock characteristics.

The organo-cerium (IV) chelates disclosed herein can be substituted for the ceric 2,2,6,6-tetramethyl-3,5-heptanedionate above with substantially the same results.

EXAMPLE XVIII

A lead free gasoline composition having enhanced octane and anti-knock characteristics is prepared by blending 0.90 percent by weight 3,6-octanediol and 0.15 percent by weight ceric 2,2,6,6-tetramethyl-3,5-heptanedionate with a gasoline having a boiling point range of from about 100° F. (37.8° C.) to about 420° F. (215.6° C.). It is to be noted that the alkanediol and organo-cerium (IV) compounds described herein can be substituted for gasoline anti-knock and octane improvement additives above with substantially the same results.

EXAMPLE XIX

A lead free gasoline composition having enhanced octane and anti-knock characteristics is prepared by mixing 0.90 percent by weight 2-methyl-3,6-octanediol and 0.15 percent by weight ceric 2,2,6,6-tetramethyl-3,5-heptanedionate with the gasoline composition of Example XVIII. The alkanediol and organo-cerium (IV) compounds as described herein can be substituted for the octane and anti-knock additives above with substantially the same results.

Obviously, many modifications and variations of the invention, as hereinabove set forth, can be made without departing from the spirit and scope thereof, and therefore only such limitations should be imposed as are indicated in the appended claims.

I claim:

1. A lead-free fuel composition having improved anti-knock and octane characteristics which comprises a liquid hydrocarbon fuel containing an anti-knock and octane improvement amount of an alkanediol of the formula:

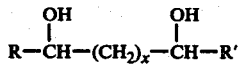

wherein R and R′ can be either alike or different, selected from hydrogen or a hydrocarbon radical having from about 1 to about 12 carbon atoms; and x is an integer of from about 1 to about 5; in combination with an organo-cerium (IV) chelate of the formula:

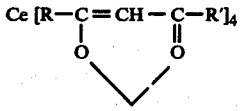

wherein R and R′ can be either alike or different members selected from the group consisting of hydrogen or hydrocarbon radicals including alkyl aryl, aralkyl, alkaryl and cyclo-alkyl radicals containing from about 1 to about 12 carbon atoms with the sum of the carbon atoms in said radicals being from about 3 to about 24.

2. The lead-free fuel composition of claim 1 having an alkanediol of the formula:

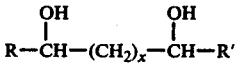

wherein R and R′ can be either alike or different, selected from hydrogen or a hydrocarbon radical having from about 1 to about 8 carbon atoms, and x is an integer of from about 1 to about 3.

3. The lead-free fuel composition of claim 1 wherein the alkanediol is selected from the group of:
1,4-pentanediol;
1,4-hexanediol;
1,5-hexanediol;
1,6-hexanediol;

2,5-hexanediol;
1,4-heptanediol;
2,5-heptanediol;
3,6-octanediol;
3-methyl-1,4-hexanediol;
6-methyl-1,4-heptanediol;
1,3-pentanediol;
2,4-pentanediol;
1,5-pentanediol;
3-methyl-2,4-pentanediol;
2,7-dimethyl-3,6-octanediol;
3,8-dimethyl-4,7-decanediol;
2,2,8,8-tetramethyl-4,7-decanediol; or 7,10-hexadecanediol, and mixtures thereof.

4. The lead-free fuel composition of claim 1 having an organo-cerium IV chelate of the formula:

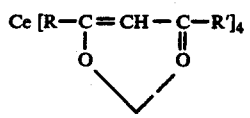

wherein R and R′ can be either alike or different members selected from the group consisting of hydrogen or hydrocarbon radicals including alkyl, aryl, aralkyl, alkaryl and cycloalkyl radicals containing from 1 to 8 carbon atoms with the sum of the carbon atoms in said radicals being from 4 to 10.

5. The lead-free fuel composition of claim 1 having an organo-cerium IV chelate of the formula:

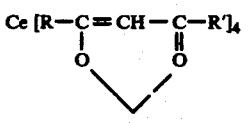

wherein R and R′ are selected from methyl, ethyl, propyl, isopropyl, n-butyl, sec-butyl, tertiary butyl, n-amyl, tertiary amyl, n-hexyl, n-heptyl, triethylmethyl, n-octyl, isooctyl, nonyl, decyl, undecyl, dodecyl, phenyl, naphthyl, benzyl, phenethyl, tolyl, xylyl, methylnaphthyl, ethylphenyl, propylphenyl, butylphenyl, amylphenyl, hexylphenyl, diethylphenyl, dipropylphenyl, trimethylphenyl, triethylphenyl, cyclopentyl, cyclohexyl or cyclooctyl radicals.

6. The lead-free fuel composition of claim 1 wherein the organo-cerium (IV) chelate is selected from the group of:
ceric 2,4-hexanedionate,
ceric 2,4-heptanedionate,
ceric 2,4-octanedionate,
ceric 3,5-heptanedionate,
ceric 3,5-octanedionate,
ceric 4,6-nonanedionate,
ceric 4,6-decanedionate,
ceric 5,7-undecanedionate,
ceric 6,8-tridecanedionate,
ceric 5,7-tetradecanedionate,
ceric 7,9-pentadecanedionate,
ceric 7,9-hexadecanedionate,
ceric 8,10-heptadecanedionate,
ceric 8,10-octadecanedionate,
ceric 9,11-nonadecanedionate,
ceric 9,11-eicosanedionate,
ceric 10,12-heneicosanedionate,
ceric 10,12-docosanedionate,
ceric 11,13-tricosanedionate,
ceric 11,13-tetracosanedionate,
ceric 12,14-pentacosanedionate,
ceric 12,14-hexacosanedionate,
ceric 13,15-heptacosanedionate,
ceric 2,2-dimethyl-3,5-hexanedionate,
ceric 2,2-dimethyl-3,5-heptanedionate,
ceric 2,2-dimethyl-3,5-octanedionate,
ceric 2,2-dimethyl-3,5-nonanedionate,
ceric 2,6-dimethyl-3,5-heptanedionate,
ceric 2,7-dimethyl-3,5-octanedionate,
ceric 2,2,6,6-tetramethyl-3,5-heptanedionate,
ceric 3,3,7,7-tetraethyl-4,6-nonanedionate,
ceric 1-phenyl-1,3-butanedionate,
ceric 1-phenyl-1,3-heptanedionate,
ceric 1-phenyl-1,3-undecanedionate,
ceric 1-phenyl-1,3-pentadecanedionate,
ceric 1-naphthyl-1,3-butanedionate,
ceric 1-benzyl-1,3-butanedionate,
ceric 1-tolyl-1,3-butanedionate,
ceric 1-cyclohexyl-1,3-butanedionate,
ceric 1,3-diphenyl-1,3-propanedionate,
ceric 1,3-dinaphthyl-1,3-propanedionate,
ceric 1,3-dibenzyl-1,3-propanedionate,
ceric 1,3-ditolyl-1,3-propanedionate, or
ceric 1,3-dicyclohexyl-1,3-propanedionate and mixtures thereof.

7. The lead-free fuel composition of claim 1 wherein the anti-knock agent comprises 2,5-hexanediol and an organo-cerium (IV) chelate.

8. The lead-free fuel composition of claim 1 wherein the organo-cerium (IV) chelate is ceric 2,2,6,6-tetramethyl-3,5-heptanedionate.

9. The lead-free fuel composition of claim 1 wherein the alkanediol and organo-cerium (IV) chelate comprise from about 0.04 to about 8.0 weight percent based on the liquid hydrocarbon fuel.

10. The lead-free fuel composition of claim 1 wherein the alkanediol and organo-cerium (IV) chelate comprise from about 0.1 to about 2.0 weight percent based on the liquid hydrocarbon fuel.

11. The lead-free fuel composition of claim 1 wherein the weight ratio of alkanediol to the organo-cerium (IV) chelate is in the range of from about 1:1 to about 50:1.

12. The lead-free fuel composition of claim 1 wherein the weight ratio of alkanediol to the organo-cerium (IV) chelate is in the range of from about 1:1 to about 6:1.

13. The lead-free fuel composition of claim 1 wherein the liquid hydrocarbon fuel is gasoline.

14. The lead-free fuel composition of claim 1 wherein the liquid hydrocarbon fuel is a synthetic fuel produced from a carbonaceous material.

* * * * *

UNITED STATES PATENT OFFICE

CERTIFICATE OF CORRECTION

Patent No. 4,133,648 Dated January 9, 1979

Inventor(s) John E. Deffner

It is certified that error appears in the above-identified patent and that said Letters Patent are hereby corrected as shown below:

COLUMNS 7 and 8,
TABLE 1, Example VIII, last line, "0." should read --0.9--.

Signed and Sealed this

*First* Day of *May 1979*

[SEAL]

*Attest:*

RUTH C. MASON
*Attesting Officer*

DONALD W. BANNER
*Commissioner of Patents and Trademarks*